US006789374B1

(12) United States Patent
Bois

(10) Patent No.: US 6,789,374 B1
(45) Date of Patent: Sep. 14, 2004

(54) METHOD AND MACHINE FOR MANUFACTURING A STRING OF BAGS PROVIDED WITH TRANSVERSE CLOSURE STRIPS, AND ARTICLES OBTAINED THEREBY

(75) Inventor: Henri Georges Bois, Neuilly-sur-Seine (FR)

(73) Assignee: Flexico-France, Henonville (FR)

( * ) Notice: Subject to any disclaimer, the term of this patent is extended or adjusted under 35 U.S.C. 154(b) by 0 days.

(21) Appl. No.: 09/720,251

(22) PCT Filed: Jul. 9, 1999

(86) PCT No.: PCT/FR99/01678

§ 371 (c)(1),
(2), (4) Date: Jan. 8, 2001

(87) PCT Pub. No.: WO00/02722

PCT Pub. Date: Jan. 20, 2000

(30) Foreign Application Priority Data

Jul. 10, 1998 (FR) ..... 98 08884

(51) Int. Cl.[7] ..... B65B 61/18

(52) U.S. Cl. ..... 53/412; 53/133.4; 53/139.2; 53/450; 53/550; 493/212; 493/213; 493/927

(58) Field of Search ..... 53/450, 412, 133.4, 53/139.2, 459, 567, 568, 550; 493/212–214, 186, 189, 199, 228–229, 927; 383/63, 65, 42

(56) References Cited

U.S. PATENT DOCUMENTS

| | | | | | |
|---|---|---|---|---|---|
| 2,257,433 | A | * | 9/1941 | Stokes | 53/451 |
| 4,709,398 | A | * | 11/1987 | Ausnit | 53/139.2 |
| 4,878,987 | A | * | 11/1989 | Ven Erden | 493/213 |
| 4,909,017 | A | * | 3/1990 | McMahon et al. | 53/412 |
| 5,007,744 | A | * | 4/1991 | Scarberry et al. | 53/451 |
| 5,564,259 | A | * | 10/1996 | Stolmeier | 53/133.4 |
| 5,669,715 | A | * | 9/1997 | Dobreski et al. | 383/64 |
| 5,713,669 | A | * | 2/1998 | Thomas et al. | 383/204 |
| 5,816,018 | A | * | 10/1998 | Bois | 53/133.4 |
| 6,017,412 | A | * | 1/2000 | Van Erden et al. | 53/133.4 |

* cited by examiner

*Primary Examiner*—Rinaldi I. Rada
*Assistant Examiner*—Thanh Truong
(74) *Attorney, Agent, or Firm*—Jacobson Holman PLLC

(57) ABSTRACT

A method of manufacturing a string of bags provided with transverse closure strips by sequentially placing closure system segments transversely on a film for forming the walls of the bag, with each segment having two complementary closure strips. The support webs are fixed respectively to the inside faces of the two walls of the bag while taking care to provide sequential transverse openings in the film so as to give access to between the two strips. A machine for implementing the method and strings of bags obtained thereby are also included.

27 Claims, 7 Drawing Sheets

METHOD AND MACHINE FOR MANUFACTURING A STRING OF BAGS PROVIDED WITH TRANSVERSE CLOSURE STRIPS, AND ARTICLES OBTAINED THEREBY

BACKGROUND OF THE INVENTION

1. Field of the Invention

The present invention relates to the field of manufacturing bags in a "string", i.e. bags that are connected one after another on leaving the manufacturing process, but suitable for being separated during a subsequent filling step or after filling.

The present invention relates more precisely to manufacturing bags provided with complementary closure strips suitable for enabling the bags to be opened and closed in alternation, on demand.

2. Description of the Related Art

Various processes have already been proposed for this purpose.

In general, systems presently known and used for making strings of bags are adapted to make strings in which the bags possess longitudinal openings, i.e. openings situated along one of the longitudinal edges of the string. Examples of such known means for making such strings are to be found in documents WO-A-94/19250 and EP-A-0 054 564.

The strings of bags obtained in that way have already given good service. Nevertheless, they do not always give satisfaction. In particular, such strings of bags with longitudinal openings require the string to be rolled out in a generally horizontal direction, if the bags are to be filled merely under gravity. Such a configuration requires an installation that is bulky. It also requires complex means for guiding the bags.

Attempts have indeed been made to avoid those difficulties by proposing means designed to make strings of bags that have transverse openings. Nevertheless, present attempts on those lines have not given complete satisfaction either.

Thus, document U.S. Pat. No. 5,118,202 proposes means for manufacturing a string of bags, adapted to place the closure strips longitudinally, while simultaneously making transverse openings on the strings. Those installations have complex means for making the transverse openings, and above all they require a bonding operation to close the bags after they have been filled, since the closure strips cannot be used for that purpose given that the closure strips extend longitudinally and not transversely like the openings.

Document WO-A-97/06062 describes other means for manufacturing a string of bags with transverse openings, adapted to place the closure strips transversely. However, in that case also the implementation means are complex. In particular they require a closure system having two complementary male/female strips whose support webs are fixed on a common sheet of the bag.

Document DE-A-3 824 753 describes a method of manufacturing a string of bags and the string of bags obtained thereby, using film that is fed onto a filling chute and that is provided with transverse complementary closure strips.

SUMMARY OF THE INVENTION

An object of the present invention is to propose novel means designed to make a string of bags.

According to the present invention, this object is achieved by a method comprising the steps which consist in sequentially placing closure system segments transversely on at least one film for forming the walls of the bag, each segment comprising two complementary closure strips, in fixing the support webs of the two complementary closure strips respectively to the inside faces of the two walls of the bag, and in providing sequential transverse openings through part of the film so as to give access to between the two strips from the outside of the closure system relative to each bag.

In a preferred implementation, the method of the present invention consists in placing transversely on the film closure system segments of a length that is about half the width of said film, in cutting the film transversely over substantially half its width outside the closure system, in folding the film over onto itself, and in fixing the support webs of the two strips of the closure system to the two walls of the bag, respectively.

The present invention also provides a machine for implementing the above method, and strings of bags obtained thereby.

The machine comprises means for sequentially placing closure system segments transversely on at least one film for forming the walls of the bag, each segment comprising two complementary closure strips, means for fixing the support webs of the two complementary closure strips respectively to the inside faces of the two walls of the bag, and the machine is characterized by the fact that it comprises means for providing sequential transverse openings through part of the film so as to give access to between the two strips from the outside of the closure system relative to each bag.

Still more precisely, the machine of the present invention preferably comprises means for placing transversely on the film closure system segments of a length that is about half the width of said film, cutting the film transversely over substantially half its width outside the closure system, folding the film over onto itself, and fixing the support webs of the two strips of the closure system to the two walls of the bag, respectively.

Strings of bags of the present invention have closure system segments comprising pairs of complementary closure strips with support webs that are fixed transversely respectively to the inside faces of the walls of the bags, the strings being characterized by a transverse opening provided through part of the film to provide access to between the two strips from the outside of the closure system relative to each bag.

BRIEF DESCRIPTION OF THE DRAWINGS

Other characteristics, objects, and advantages of the present invention will appear on reading the following detailed description with reference to the accompanying drawings given as non-limiting examples and in which.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The preferred method of the present invention is described initially with reference to accompanying FIGS. 1 to 4.

Figure 1:
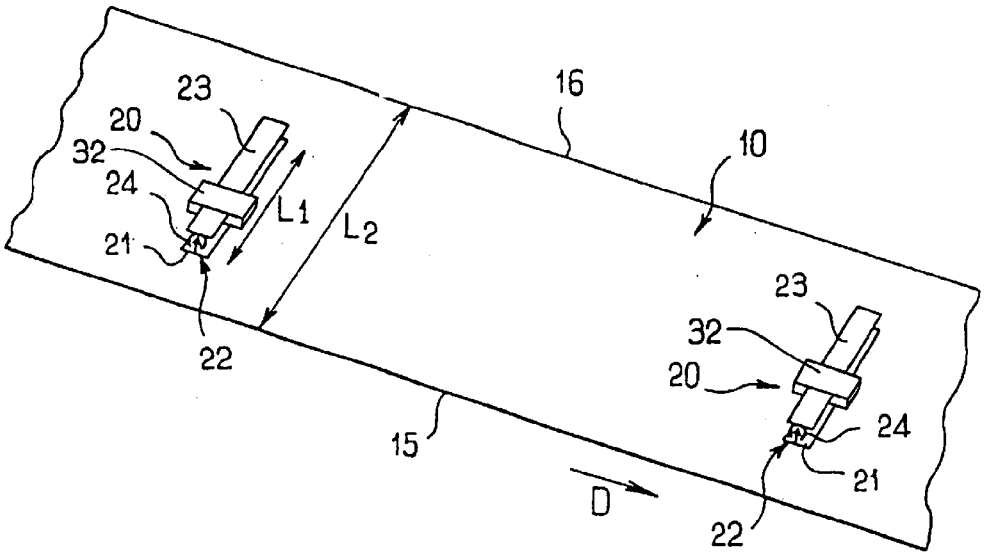
FIGS. 1, 2, 3, and 4 are diagrams showing four successive steps in a method of manufacturing a string of bags in accordance with the present invention.

FIG. 1 shows a step which consists in placing closure system segments 20 on a film 10. During this step, the film 10 is preferably travelling continuously in the length direction, i.e. in direction D. The closure system segments 20 are placed transversely on the film 10, i.e. perpendicularly to the direction D.

In a variant, the film 10 could travel intermittently.

During this step, the support web 21 of the bottom closure strip 22 adjacent to the film 10 is bonded thereto.

The closure system segments 20 are of a length L1 which is equal to half the width L2 of the film 10 or substantially equal to half said width L2.

As shown in FIG. 1, the closure system segments 20 are centered on the width of the film 10. However, in a variant, it is possible to envisage placing the closure system segments 20 off-center relative to the film 10, e.g. placing the segment 20 at least substantially adjacent to one of the edges of the film 10.

Figure 5:
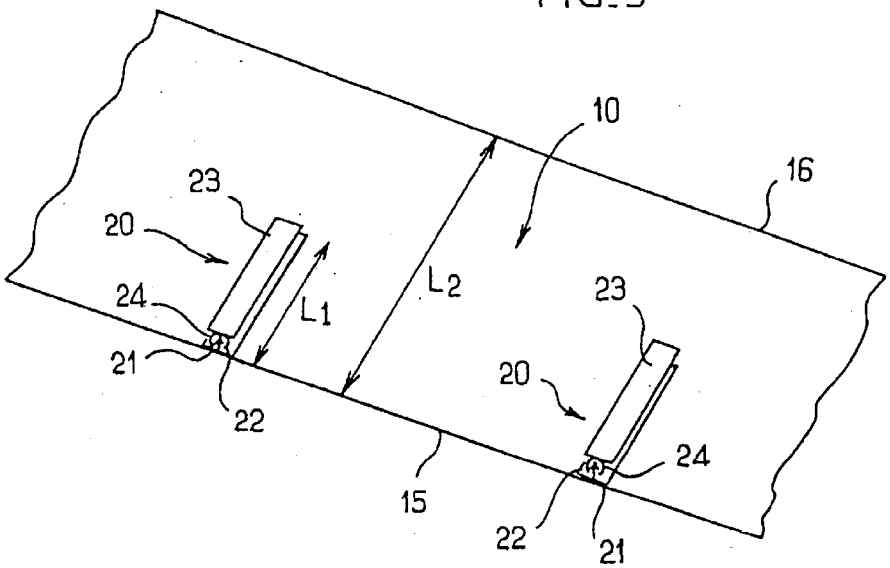
FIG. 5 shows a variant of the step of FIG. 1, when the closure strips are off-center.

One such variant with off-center segments 20 is shown in FIG. 5.

Figure 10:
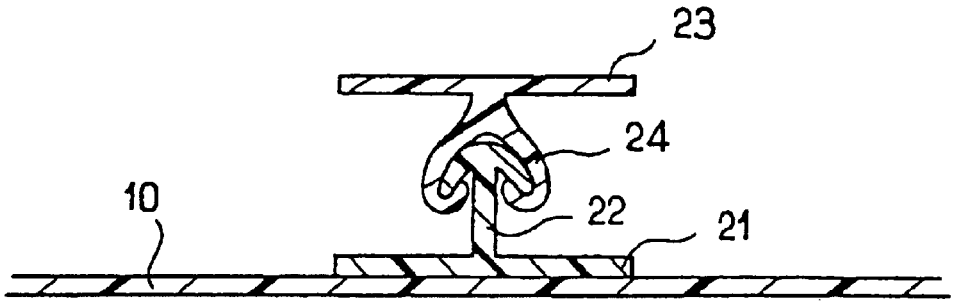
FIGS. 10 and 11 are section views through closure strips in two variant embodiments of the present invention.

The closure strips 20 can be implemented in numerous ways. They are preferably respectively a male strip 22 and a complementary female strip 24 carried by respective support webs 21 and 23. Such an embodiment is shown diagrammatically in FIG. 10. The structure of such complementary male/female strips 22/24 is conventional and is therefore not described in greater detail below.

Figure 11:
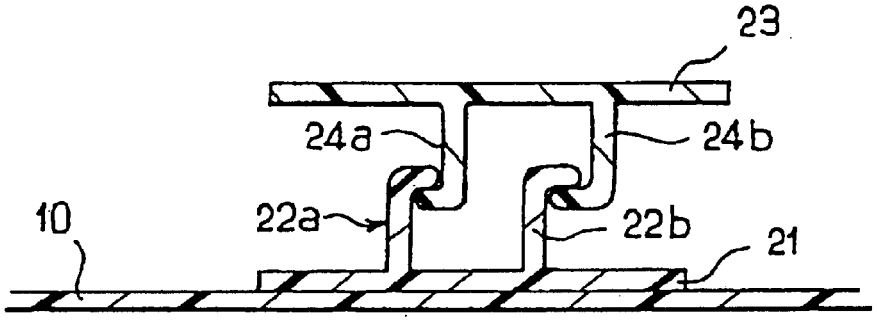

However, in a variant as shown in FIG. 11, the complementary closure strips 20 can be constituted by hook-shaped structures 22*a*, 22*b*, 24*a*, and 24*b* likewise carried by respective webs 21 and 23.

Figure 2:
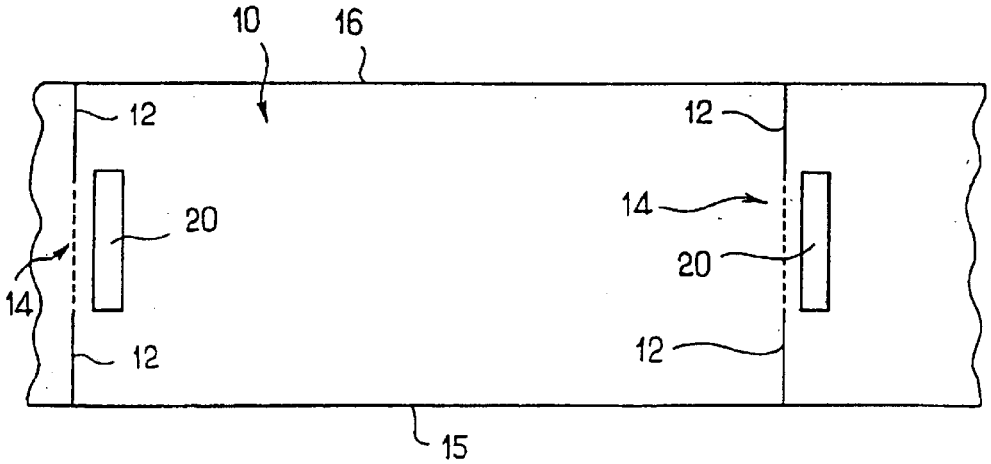

As shown in FIG. 2, the film 10 is then cut transversely and sequentially in the vicinity of the segments 20, but the line of cut 12 is nevertheless limited to the portions outside the closure segments 20. When the closure strip segments 20 are centered on the film 10, two lines of cut 12 are thus formed in alignment, each being of a length that is equal to about one-fourth of the width L2 of the film 10 and each opening out to a respective one of the longitudinal edges of the film 10.

The lines of cut 12 are made in zones of the film that lie outside the bags relative to the closure strips 20.

Where appropriate, it is possible simultaneously to precut a line of weakness 14 between the cut segments 12. Such a line of weakness 14 is intended to make it easier to separate bags later on. This line of weakness 14 can be constituted by a run of through dashes.

Figure 3:
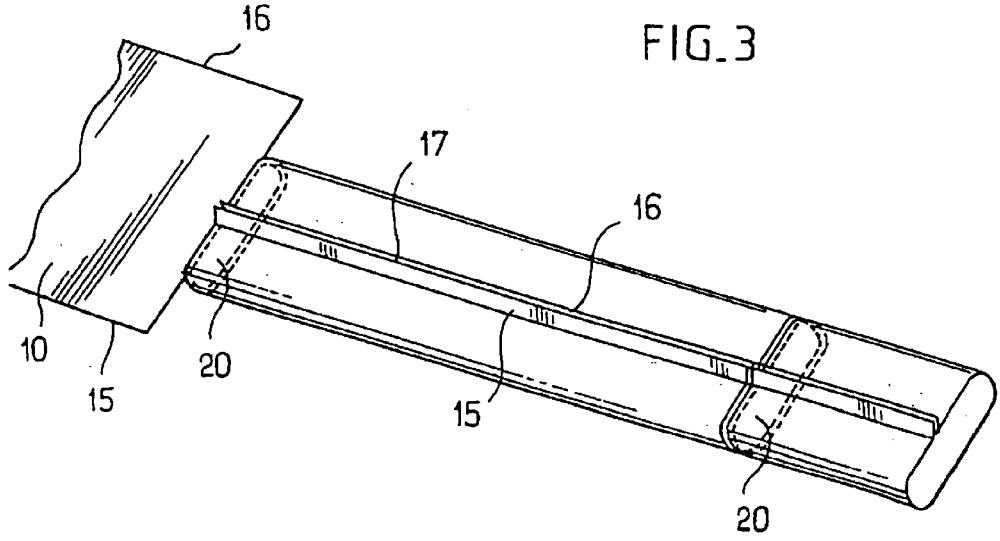

Thereafter, as shown in FIG. 3, the film 10 is folded over onto itself and the two longitudinal edges 15 and 16 of the film 10 are bonded together. This is referenced 17 in FIG. 3.

Figure 4:
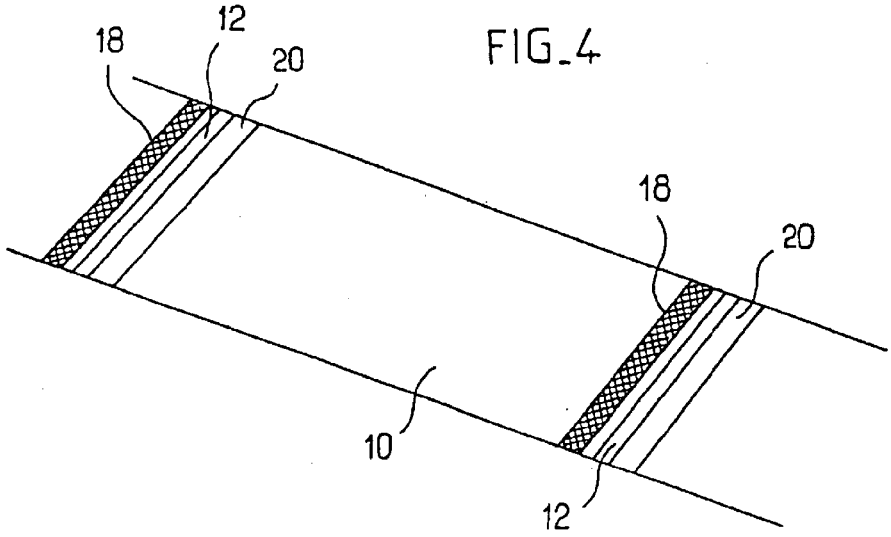

Thereafter, as shown in FIG. 4, the support web 23 of the top closure strip 24 is bonded to the adjacent wall of the bag formed by folding over the film 10. Simultaneously, the two walls of the bag are bonded together transversely at the bottom 18 of the bag.

The bonding 18 must naturally be performed at a distance from the strips 20, over the line of cut 12. The distance between the strips 20 and the bonding 18 defines the depth of the bags.

Figure 6:
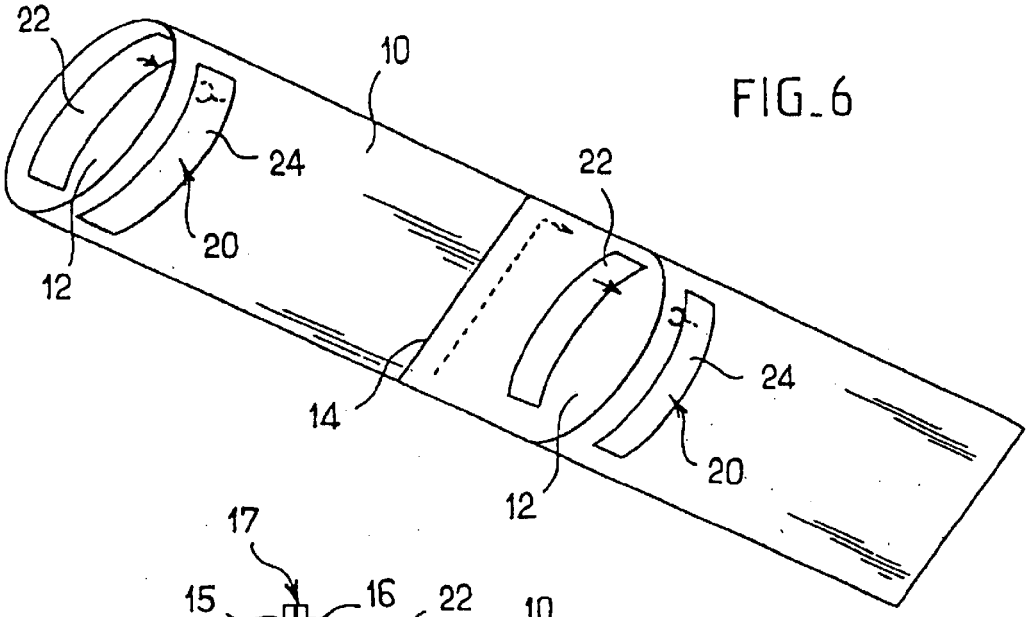
FIG. 6 is a diagram showing a string of bags of the present invention.

As shown in FIG. 6, this gives rise to a string of bags having transverse closure strips 20 that are directly accessible via the lines of cut 12.

Consequently, to fill these bags it suffices to open the closure system 20 and then to close it again on the content of the bag.

Figure 7:
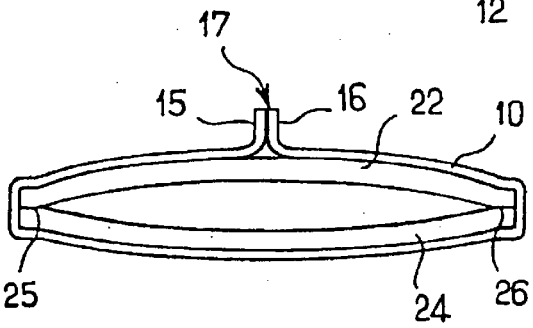
FIG. 7 is a cross-section view through the mouth of a bag of the present invention in a variant embodiment in which the closure strips are assembled in the open position.

In a variant shown diagrammatically in FIG. 7, it is possible to feed closure strip segments 20 and to fix them to the walls of the bag in the open state, i.e. in a state where the two closure strips 22 and 24 are separate. In this configuration, the two closure strips 22 and 24 are nevertheless preferably united at their ends by respective bonds 25, 26.

Figure 8:
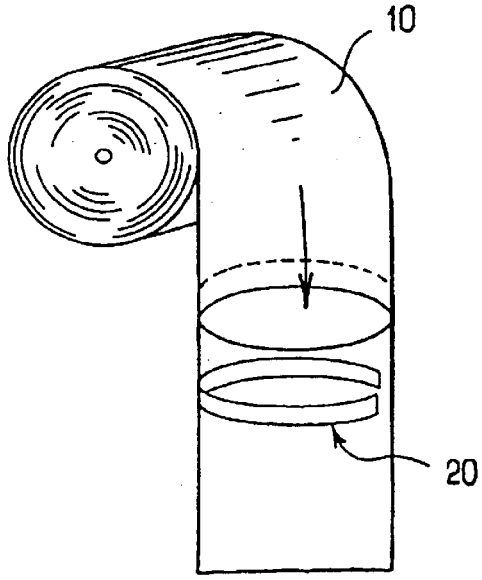
FIG. 8 shows a string of bags of the present invention disposed in a roll.

As shown diagrammatically in FIG. 8, a string of bags can be rolled up prior to filling, so as to form a roll suitable for feeding a packaging machine.

The packaging machine preferably has means suitable for opening the closure systems 20 if previously closed, for filling the bags under gravity, and for reclosing the systems 20. Where appropriate, bag closure can be accompanied by bonding together the walls of the bag, outside the closure systems 20.

The bags can then easily be separated from one another by breaking the lines of weakness 14.

The means of the present invention make it possible to make a string of bags each provided with complementary closure strips 20 and suitable for automatic packaging. These means are simple.

Furthermore, while the bags are being filled, the means for guiding the string can also be very simple. It suffices merely to have a shaft supporting the rolled-up string of bags.

Various means can be provided to prevent the strips 22 and 24 or the supporting webs 21 and 23 bonding together, during the steps in which the closure assemblies 20 are fixed to the film 10.

Figure 12:
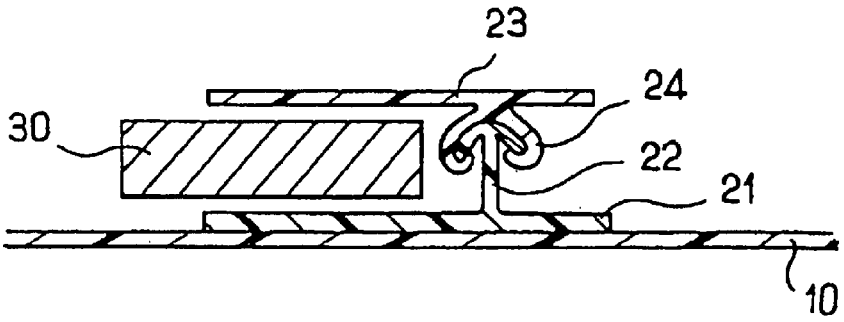
FIG. 12 is a similar view of closure means showing an insulating insert inserted between the support webs to prevent them bonding together.

By way of example, FIG. 12 shows that it is possible to provide an insert 30 associated with heat-sealing jaws and suitable for being placed between the support webs 21, 23.

In another variant, at least one of the support webs 21 and 22 can be implemented in the form of a multi-layer structure each having an outer layer and an inner layer where the outer layers have a melting temperature that is lower than that of the inner layers.

Figure 13:
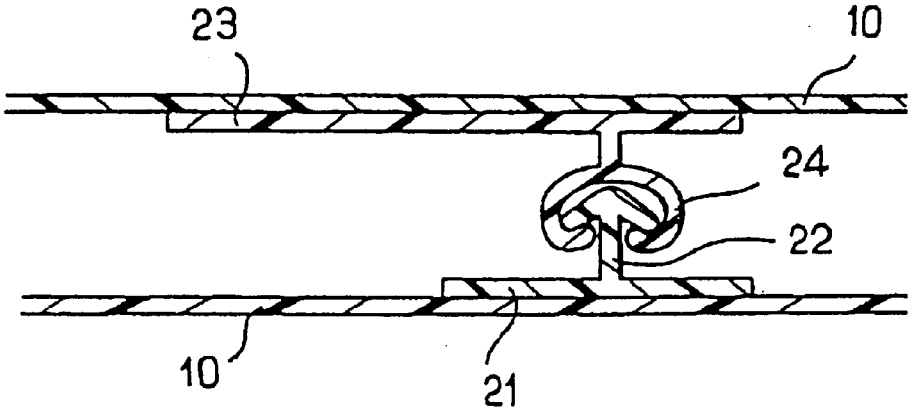
FIG. 13 is another view of closure means constituting a variant having support webs of different widths.

In yet another variant, as shown diagrammatically in FIG. 13, support webs 21 and 22 can be provided that are of different widths. Under such circumstances, the wider support web preferably corresponds to the top support web which is the last to be fixed to the film 10.

Figure 14:
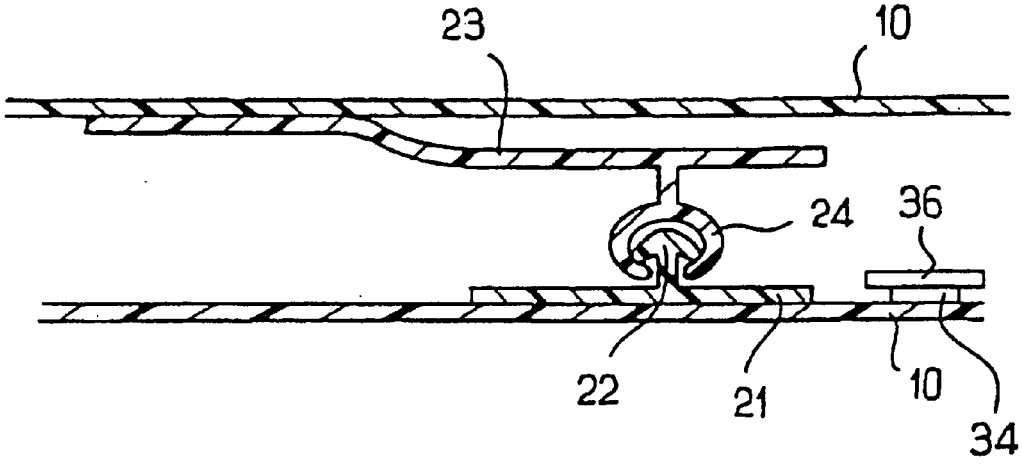
FIG. 14 is another view of such closure means having a single support web that is fixed to the film in part only.

It is also possible to bond at least one of the support webs 21, 23 over a fraction only of its width, preferably using the longitudinal margin of the support web that is situated towards the outside. Such a variant is shown in FIG. 14 for the top web 23. This variant allows the pressure inside the bag to tend to lift the zone of the support web 23 underlying the strips away from the film 10, consequently tending to act on the mutually engaged strips 22 and 24.

According to yet another variant, the closure system 20 may be fitted with an actuating slide 32. In conventional manner, such a slide makes it easier to handle the closure strips 22 and 24, both for opening and for closing.

Various embodiments of such slides are known to the person skilled in the art, so such slides are not described in detail below. Nevertheless, in the context of the present invention, it is preferable for each slide to comprise a sole plate which carries two side flanges on one face together with a central separating rib which co-operates with the two side flanges to define two converging/diverging passages (depending on the travel direction) for receiving respective ones of the strips 22 and 24.

Each closure system segment 20 can be prefitted with a slide when it is put into place on the film 10. Nevertheless, in a variant, slides can be added to the closure strips 20 after they have been fixed to the film 10, at least after the first support web 21 has been fixed to the film 10. Examples of means suitable for adding a slide are to be found in documents EP-A-0 510 100, EP-A-0 102 301, and EP-A-0 479 661.

The film 10 (or the sheets 10*a* and 10*b*) can be implemented in numerous ways. They can be a simple film of thermoplastic material or a multi-layer thermoplastic film, i.e. a film made up of a plurality of juxtaposed layers of different kinds, or a laminated film e.g. made up of paper coated with a layer of plastics material, or a metallized film.

Naturally, the present invention is not limited to the embodiments described above, but extends to any variants within its spirit.

Figure 9:
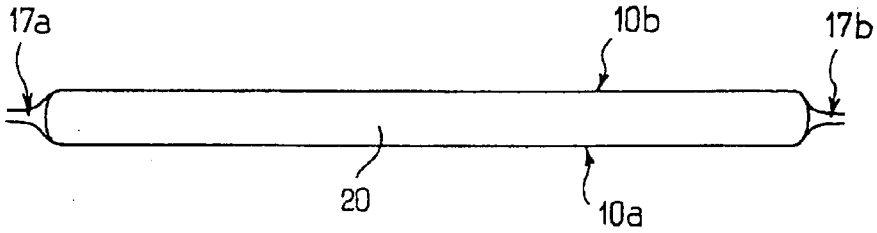
FIG. 9 is a cross-section view through a bag of the present invention made using two separate sheets of film.

Thus, for example, as shown diagrammatically in FIG. 9, it is possible in a variant to envisage making strings of bags by using two sheets of film 10*a* and 10*b* that are superposed instead of by using a single film 10.

Under such circumstances, care must be taken to ensure that a line of cut is made in at least one of the two sheets 10*a*, 10*b* to give access to the closure strips 20 or else to feed this sheet (preferably the top sheet 10*b*) in the form of successive segments of a length corresponding to the depth of the bags. The two sheets 10*a* and 10*b* are bonded together along their longitudinal edges 15 and 16 as shown diagrammatically at 17*a* and 17*b* in FIG. 9.

In yet another variant, the above-mentioned bonds, in particular the bonds between the walls of the bag outside the closure strips 20 and extending transversely after the bags have been filled are not made by heat-sealing, but rather by adhesive. For this purpose, as shown in FIG. 14, it is possible to place a strip of suitable adhesive 34, preferably a strip of sticky material on one of the walls of the film at the mouth of each bag. To prevent the strip 34 from adhering to the bag too soon and in the wrong place, the adhesive strip can be covered in a peel-off film 36.

Figure 15:
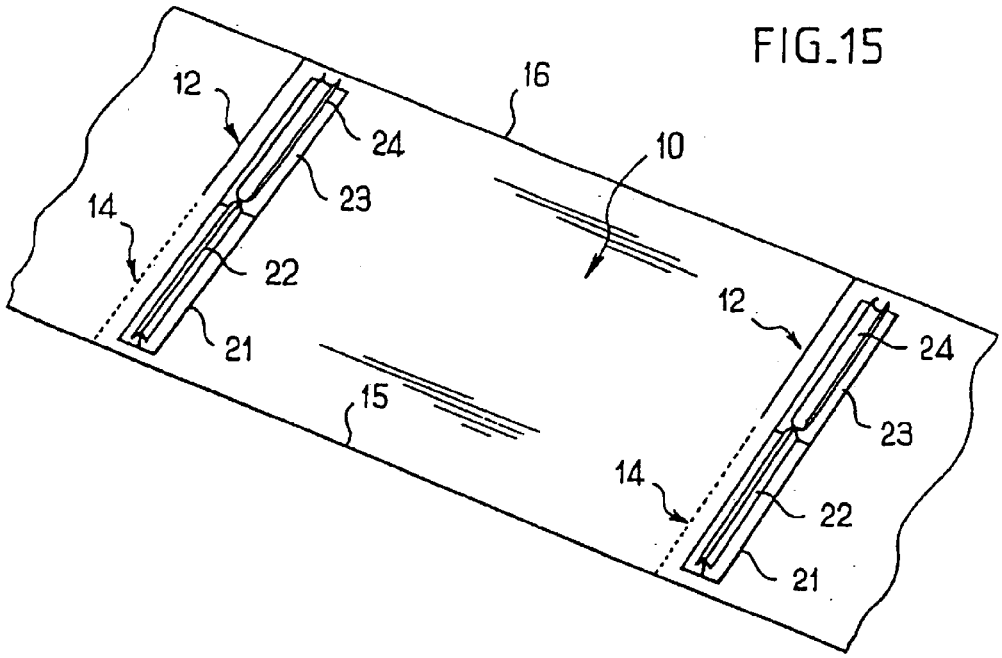
FIG. 15 is a view similar to FIG. 5 showing another variant embodiment.
Figure 16:
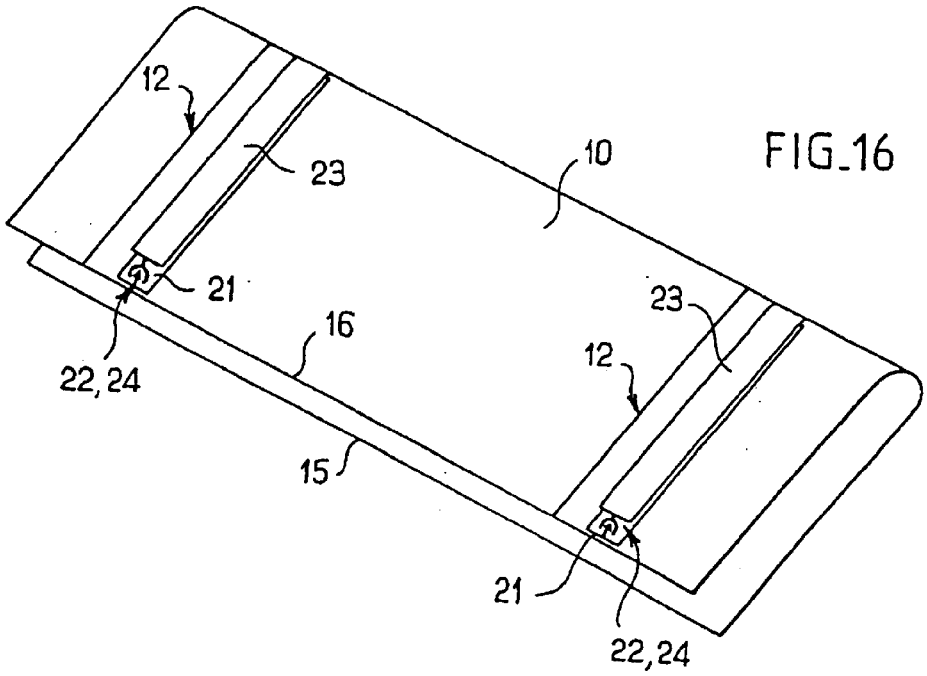
FIG. 16 is a later view of the manufacturing process.

The variant embodiment shown in FIGS. 15 and 16 is described below.

In the embodiments described above, the strips 22 and 24 are placed facing each other (and mutually engaged in the embodiments shown in FIGS. 1 to 5, or on the contrary separate but interconnected via their ends in the embodiment shown in FIG. 7) when they are fed transversely onto the film 10.

In contrast, in the variant shown in FIGS. 15 and 16, when the complementary strips 22 and 24 are fed on the film 10 they are not facing each other but instead they are in alignment, i.e. one after another when moving across the film 10 transversely.

Consequently, the support webs 21 and 23 carrying the respective closure strips 22 and 24 are then preferably bonded to the film simultaneously and not successively as described above. Nevertheless, in a variant, it is still possible to envisage bonding the web 21 initially and bonding the web 23 subsequently, e.g. after the film has been folded.

The strips 22 and 24 can be constituted by separate strips that are fed onto the film in succession or they can be connected together in the position shown in FIG. 15 when they are fed simultaneously onto the film 10.

The strips 22 and 24 are subsequently placed to face each other during a step in which the film 10 is folded over onto itself as shown in FIG. 16. During this operation, the strips 22 and 24 can be moved into engagement, or in a variant they can be held facing each other but separate with engagement taking place subsequently only after the bag has been filled.

The subsequent operations of manufacturing the bag (essentially longitudinal bonding 17 between the edges of the film and transverse bonding 18) remain essentially the same as in the variants described above.

In particular, it should be observed that in this case also it is preferable for the film 10 to be split over half its width prior to being folded over onto itself so as to form the transverse opening that is necessary to give access to between the strips 22 and 24.

In FIG. 15, the line of cut is thus formed through the film 10 over half of its width and is referenced 12.

This line of cut 12 is preferably extended by a line of weakness 14 so as to make the bags easier to separate subsequently.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A method of manufacturing a string of bags provided with transverse closure strips comprising the steps of:

sequentially placing closure system segments transversely on at least one film for forming the walls of the bags, each segment including two complementary closure strips;

fixing support webs of the two complementary closure strips respectively to inside faces of the two walls of the bag; and providing sequential transverse openings substantially parallel with said closure strips through part of the film so as to give access to between the two closure strip from outside of the closure system relative to each bag, said transverse openings remaining unsealed throughout said above method manufacturing.

2. The method according to claim 1, wherein the opening is formed by cutting the film transversely outside the closure system.

3. The method according to claim 2, wherein the film is folded over onto itself after making the cut.

4. The method according to claim 1, wherein closure system segments of a length that is about half a width of said film are placed transversely on said film, the film is cut transversely over substantially half of said width outside the closure system, the film is folded over onto itself, and the support webs of the two strips of the closure system are fixed to the two walls of the bag, respectively.

5. The method according to claim 3, wherein the support web of a bottom closure strip adjacent to the film is bonded thereto before the film is folded, and the support web of a top closure strip is bonded to the film after the film has been folded.

6. The method according to claim 1, wherein the closure system segments are centered across a width of the film.

7. The method according to claim 1, further comprising the step of bonding together longitudinal edges of the film after at least one fold has been formed in the film.

8. The method according to claim 1, further comprising the step of making a line of weakness between laterally aligned transverse openings in a portion of film that forms a wall of the bag.

9. The method according to claim 1, further comprising the step of bonding together transversely the two walls of the bag at a bottom of the bag.

10. The method according to claim 1, further comprising the step of rolling up the string of bags before they are filled so as to form a roll suitable for feeding a packaging machine.

11. The method according to claim 1, wherein the closure system is fitted with an actuating slide.

12. The method according to claim 1, further comprising the step of placing a strip of adhesive material covered with a peel-off strip, on one of the walls of the film, at mouths of the bags.

13. A machine for manufacturing a string of bags provided with transverse closure strips comprising:

means for sequentially placing closure system segments transversely on at least one film for forming the walls of the bags, each segment including two complementary closure strips;

means for fixing support webs of the two complementary closure strips respectively to inside faces of the two walls of the bag; and means for providing sequential transverse openings substantially parallel with and adjacent said closure strips and through part of the film so as to give access to between the two closure strips from outside of the closure system relative to each bag, said transverse opening remaining unsealed, and being used in conjunction with said closure strips for filling the bag through said transverse opening.

14. The machine according to claim 13, further comprising means for placing transversely on the film closure system segments of a length that is about half a width of said film, means for cutting the film transversely over substantially half of said width outside the closure system, means for folding the film over onto itself, and means for fixing the support webs of the two strips of the closure system to the two walls of the bag, respectively.

15. The machine according to claim 13, wherein the closure system segments are centered on a width of the film.

16. The machine according to claim 13, further comprising means suitable for bonding together longitudinal edges of the film after the film has been folded at least once.

17. The machine according to claim 13, further comprising means suitable for making a line of weakness between laterally aligned transverse openings in a film portion forming a wall of the bag.

18. The machine according to claim 13, further comprising means suitable for transversely bonding together the two walls of the bag at a bottom thereof.

19. The machine according to claim 13, further comprising means suitable for rolling up the string of bags prior to filling so as to form a roll suitable for feeding a packaging machine.

20. The machine according to claim 13, further comprising means suitable for receiving a closure system fitted with an actuating slide.

21. The machine according to claim 13, further comprising means suitable for placing on one of the walls of the film, at mouths of the bags, a strip of adhesive material at least partly covered by a strip of peel-off film.

22. A string of bags, the string comprising closure system segments, including pairs of complementary closure strips with support webs that are fixed transversely respectively to the inside faces of the walls of the bags, each pair of complementary closure strips being adjacent and generally parallel with a respective transverse opening through part of the film that provides access to between the respective two strips from the outside of the closure system relative to each bag, said transverse opening remaining unsealed, and being used in conjunction with said closure strips for filling the bag through said transverse opening.

23. The string of bags according to claim 22, wherein said string of bags is made using a single film folded over onto itself.

24. The string of bags according to claim 22, wherein said string of bags has a line of weakness between each pair of adjacent bags.

25. The string of bags according to claim 22, wherein said string is presenting in a roll suitable for feeding to a package machine.

26. The string of bags according to claim 22, wherein the closure system is fitted with an actuating slide.

27. The string of bags according to claim 22, further comprising on one of the film walls, at mouths of the bags, a strip of adhesive material that is at least partly covered by a strip of peel-off film.

* * * * *